US010714818B2

(12) United States Patent
Reichardt et al.

(10) Patent No.: US 10,714,818 B2
(45) Date of Patent: Jul. 14, 2020

(54) REAR SPOILER FOR A MOTOR VEHICLE

(71) Applicant: AUDI AG, Ingolstadt (DE)

(72) Inventors: Lars Reichardt, Wettstetten (DE); Christian Morscher, Karlshuld (DE)

(73) Assignee: AUDI AG, Ingolstadt (DE)

( * ) Notice: Subject to any disclaimer, the term of this patent is extended or adjusted under 35 U.S.C. 154(b) by 70 days.

(21) Appl. No.: 15/777,103

(22) PCT Filed: Nov. 10, 2016

(86) PCT No.: PCT/EP2016/001867
§ 371 (c)(1),
(2) Date: May 17, 2018

(87) PCT Pub. No.: WO2017/084746
PCT Pub. Date: May 26, 2017

(65) Prior Publication Data

US 2019/0341680 A1 Nov. 7, 2019

(30) Foreign Application Priority Data

Nov. 21, 2015 (DE) ..... 10 2015 015 105

(51) Int. Cl.
*H01Q 1/32* (2006.01)
*H01Q 1/12* (2006.01)

(52) U.S. Cl.
CPC ..... *H01Q 1/3291* (2013.01); *H01Q 1/1221* (2013.01)

(58) Field of Classification Search
CPC ..... H01Q 1/1221; H01Q 1/3291
USPC ..... 296/180.1
See application file for complete search history.

(56) References Cited

U.S. PATENT DOCUMENTS

| | | | | |
|---|---|---|---|---|
| 5,177,493 | A | 1/1993 | Kawamura | |
| 2009/0015495 | A1 | 1/2009 | Yoshie | |
| 2016/0056534 | A1* | 2/2016 | Nakane | H01Q 1/12 343/713 |

FOREIGN PATENT DOCUMENTS

| | | | | |
|---|---|---|---|---|
| DE | 10 2009 036 727 | A1 | 3/2010 | |
| DE | 102009036727 | A1 * | 3/2010 | H01Q 1/3283 |
| DE | 10 2014 209 702 | A1 | 11/2015 | |
| DE | 102015015105.3 | | 11/2015 | |
| EP | 1 376 756 | A2 | 1/2004 | |
| JP | 2003-273617 | A1 | 9/2003 | |
| JP | 2008-92463 | | 4/2008 | |
| KR | 10-2005-0018244 | | 2/2005 | |

(Continued)

OTHER PUBLICATIONS

English Translation by WIPO dated May 24, 2018 of the International Preliminary Report on Patentability in corresponding International Patent Application No. PCT/EP2016/001867.

(Continued)

*Primary Examiner* — Joseph D. Pape
*Assistant Examiner* — Dana D Ivey
(74) *Attorney, Agent, or Firm* — Staas & Halsey LLP

(57) ABSTRACT

A rear spoiler body affecting flow around the vehicle is provided with a recess for accommodating at least one antenna of the motor vehicle on which the rear spoiler body is mounted. Provision is made in or on the rear spoiler body for fastening the at least one antenna, such as a screw hole, unpainted surface to accept an adhesive, etc.

18 Claims, 2 Drawing Sheets

(56) References Cited

FOREIGN PATENT DOCUMENTS

| | | |
|---|---|---|
| WO | 2014/156347 | 10/2014 |
| WO | PCT/EP2016/001867 | 11/2016 |

OTHER PUBLICATIONS

International Search Report for PCT/EP2016/001867 dated Feb. 9, 2017.
German Office Action for German Application No. 10 2015 015 105.3 dated Oct. 27, 2016.
Chinese Office Action for Chinese Application No. 201680067180.2 dated Jan. 11, 2019.

* cited by examiner

REAR SPOILER FOR A MOTOR VEHICLE

CROSS REFERENCE TO RELATED APPLICATIONS

This application is the U.S. national stage of International Application No. PCT/EP2016/001867 filed Nov. 10, 2016 and claims the benefit thereof. The International Application claims the benefit of German Application No. 10 2015 015 105.3 filed on Nov. 21, 2015, both applications are incorporated by reference herein in their entirety.

BACKGROUND

Described below are a rear spoiler for a motor vehicle, a motor vehicle, and a rear spoiler system.

DE 10 2009 036 727 A1 discloses an arrangement of a transmitting and/or receiving unit on a body component of a motor vehicle. An antenna is arranged here in the region of a panel which is accommodated in a corresponding cutout of the body component. A further device of the transmitting and/or receiving unit is arranged in a cavity which is bounded by the body component and an associated interior trim panel.

EP 1 376 756 A2 discloses a rear spoiler for a motor vehicle, in which an antenna is arranged in a cavity of the rear spoiler.

JP 2008-92463 likewise discloses a spoiler for a motor vehicle, in which an antenna is fastened in a cavity of the spoiler.

SUMMARY

Described below is a rear spoiler for a motor vehicle, with which different variants of motor vehicle can be equipped particularly cost-effectively. Also described are a particularly cost-effective rear spoiler system with a rear spoiler and an antenna, and a particularly cost-effective motor vehicle of the type indicated above.

Advantageous refinements with expedient developments are described with advantageous refinements of the spoiler, the rear spoiler system and the motor vehicle that each constitute mutually advantageous refinements.

A first aspect is a rear spoiler for a motor vehicle having a rear spoiler body for influencing a flow around the vehicle. The rear spoiler body has a recess for accommodating, and a measure for fastening, at least one antenna of the motor vehicle. The measure for fastening may be arranged here on or in the recess. For example, the measure can be a screw hole, a surface which is prepared by a protective film, degreasing and/or an unpainted region for the adhesive bonding of the antenna, a screw connection and/or a thread. The rear spoiler body can be formed, for example, from a plastic.

The rear spoiler body can thus already be painted and/or the individual parts thereof ready assembled before the antenna is fastened. A decision can then be taken only upon final assembly on a manufacturing assembly line as to whether an antenna is or is not to be fastened to the rear spoiler. Depending on the individual outfitting of a motor vehicle variant, more or fewer antennas or no antennas at all may be necessary. For example, in a desired outfitting requiring numerous data services and a particularly stable radio connection, an antenna can be fastened in a simple manner to the rear spoiler only in the final assembly without having to modify the rear spoiler body. If, by contrast, an antenna is not necessary on the rear spoiler body, the same rear spoiler body can also be installed without further modifications. Owing to the fact that the antenna is arranged in the recess, the logistics for the assembly and manufacturing of the rear spoiler are therefore substantially simplified. In particular, the rear spoiler body can be purchased as a finished supplier part prior to the final assembly. Different motor vehicle variants can therefore be equipped in a particularly favorable manner with a rear spoiler since the same rear spoiler can be used for different motor vehicle variants. In contrast thereto, when the antenna is integrated in an interior of the rear spoiler body, a decision already has to be made during the manufacturing of the rear spoiler body as to whether an antenna is or is not to be installed.

The recess is therefore a type of cutout, a trough in the surface or a depression in the rear spoiler body. The recess does not constitute any interior space in the rear spoiler body. That is to say, it is not envisaged fastening the antenna in a closed interior space of the rear spoiler body. It is thereby possible initially to construct the rear spoiler body in a completely finished manner. At the same time, the installation of the antenna on the rear spoiler body is thus particularly cost-effective. The recess is easily accessible from the outside for the fastening of the antenna. In contrast to an interior space or cavity in the rear spoiler body, there are also particularly few space restrictions when using respective installation tools. As a result, the installation is possible in a particularly simple and rapid and therefore also particularly cost-effective manner.

The rear spoiler body may be shaped in such a manner that it advantageously influences the aerodynamics of the motor vehicle when the latter is in motion. However, the rear spoiler body can also serve merely to design the visual appearance of the motor vehicle. The rear spoiler body can also be arranged here in what is referred to as a dead water region of the motor vehicle. There, the rear spoiler body does not influence the flow around the vehicle during normal forward travel. However, the rear spoiler body then influences the flow around the vehicle at least during reversing travel. The antenna can be in particular an antenna for a cell phone of the motor vehicle. The rear spoiler may be positioned as high as possible on the motor vehicle for particularly good positioning of the antenna in the vertical direction of the vehicle. For example, the rear spoiler can be provided on a rear roof edge of the motor vehicle. The higher the position of the antenna, the better signals can generally be received and transmitted.

In a further advantageous refinement of the rear spoiler, it is provided that the antenna can be accommodated in the recess in such a manner that the antenna is invisible in an installed position of the rear spoiler body on the motor vehicle. Additional trim panels for concealing the antenna then have to be provided. At the same time, the measure for fastening the antenna does not have to be concealed and/or removed since it is not possible for the measure to be visible even when an antenna is not mounted in the installed position of the rear spoiler body.

In a further advantageous refinement of the rear spoiler, it is provided that the recess is provided on a side facing a vehicle body in an installed position of the rear spoiler body. When the rear spoiler is fitted on the motor vehicle, the antenna is thereby automatically concealed by the rear spoiler and also at least partially protected from environmental influences. In principle, the vehicle body and the rear spoiler body can thus together form a cavity in which the antenna is accommodated. For this purpose, the antenna can first of all be fastened to the rear spoiler body, and the rear spoiler body can subsequently be fastened to the vehicle body. Such an installation sequence is particularly simple and cost-effective. At the same time, it is thus not necessary to attach additional trim and protective elements for the antenna to the rear spoiler body.

In a further advantageous refinement of the rear spoiler, it is provided that the measure for fastening the antenna is a fastening element, in particular configured as part of a clip connection. A fastening element permits a particularly secure fastening of the antenna to the rear spoiler body. The clip connection makes particularly simple and rapid installation possible. In particular, it is optionally not necessary to have to use a tool during the installation of the clip connection.

In a further advantageous refinement of the rear spoiler, it is provided that the measure is configured as preparation for adhesively bonding the antenna to the rear spoiler body in the recess, in particular as a protective film, an unpainted partial region of a surface of the rear spoiler body and/or as a grease-free partial region of the surface of the rear spoiler body. A grease-free surface may also be referred to as a cleaned surface. The antenna can thus be adhesively bonded into the recess in a particularly simple manner. The fastening with an adhesive connection is particularly simple and cost-effective. Such a configuration of the measure is particularly advantageous if the recess is provided on the side facing the vehicle body in the installed position of the rear spoiler body and/or is not visible in the installed position of the rear spoiler body on the motor vehicle. The measure then does not have to be removed if an antenna is not fastened to the rear spoiler body.

In a further advantageous refinement of the rear spoiler, it is provided that, in the installed position of the rear spoiler on the motor vehicle, the recess continues to be accessible for the mounting of the antenna in the recess. It is then possible also to mount the antenna after the rear spoiler body is fastened to the motor vehicle. This can be advantageous for logistical reasons during the assembly of the motor vehicle. In addition, when required, the antenna can thus be retrofitted without removal of the rear spoiler body or the rear spoiler.

A second aspect relates to a rear spoiler system, including a rear spoiler according to the first aspect and the antenna, which is fastened to the rear spoiler body, of the motor vehicle. The features and advantages emerging from the use of the rear spoiler according to the first aspect can be gathered from the descriptions of the first aspect, wherein advantageous refinements of the first aspect should be considered to be advantageous refinements of the second aspect, and vice versa. The antenna is in particular fastenable here to the rear spoiler in a cost-effective manner. As a result, the rear spoiler system the rear spoiler and the antenna is also particularly cost-effective.

A third aspect relates to a motor vehicle having a rear spoiler arranged on a vehicle body with a rear spoiler body for influencing a flow around the vehicle, and an antenna accommodated in a recess of the rear spoiler body and the antenna is fastened to the rear spoiler body, wherein the rear spoiler body has a measure for fastening the antenna. The motor vehicle according to the third aspect can therefore include a rear spoiler according to the first aspect and/or a rear spoiler system according to the second aspect. The features and advantages arising from the use of the rear spoiler according to the first aspect or from the use of the rear spoiler system according to the second aspect can be gathered from the descriptions of the first or second aspect, wherein the advantageous refinements of the first or the second aspect should be considered to be advantageous refinements of the third aspect, and vice versa.

For particularly good reception of the antenna, the rear spoiler body may be arranged on a rear upper roof edge of the vehicle body. In particular, the rear spoiler body can be connected to a roof lining and/or to an upper side of a roof of the motor vehicle. The upper side of the roof and an upper side of the rear spoiler body can be flush here.

In a further advantageous refinement of the motor vehicle, it is provided that the antenna is connected to a transceiver device in an interior of the motor vehicle by a connecting line, wherein the connecting line is guided through the vehicle body with a grommet sealing the vehicle body. It is desirable that the connecting line is connected to the antenna in a waterproof manner. For this purpose, the connecting line can be, for example, soldered to the antenna and subsequently cast, for example into a plastic, at the connecting point. Alternatively, the connecting line can also be connected to the antenna with a waterproof plug. The grommet seals the interior of the motor vehicle or of the vehicle body against water penetrating from the outside at a passage opening for the connecting line. The passage opening may also be referred to here as a through opening. As a result, no water can penetrate at the passage into the motor vehicle and lead to corrosion there and/or to damage of electronics. At the same time, it is thus not necessary to connect the connecting line to the transceiver device in a manner protected against liquids. The connection can thereby be particularly cost-effective. At the same time, it is not necessary to protect the antenna and/or the connecting line in the recess against moisture and water. The recess can therefore be what is referred to as a moist space of the motor vehicle.

In a further advantageous refinement of the motor vehicle, it is provided that the connecting line is connected to the transceiver device by a waterproof plug. When the above-described grommet is used, the transceiver device can thus be particularly readily protected against water that nevertheless penetrates. Alternatively, however, it may thus also be superfluous to guide the connecting line with a grommet through a through opening in the vehicle body. The grommet can thereby be dispensed with. Use can therefore be made in particular of a through opening in the vehicle body that is already used for other connecting lines. The reduced number of required through openings means that the vehicle body can be produced particularly cost-effectively. The transceiver device here may be designed in a manner protected against moisture and/or penetrating water. In particular, the transceiver device can be arranged here in a cavity of the vehicle body, the cavity not being sealed against penetrating water.

BRIEF DESCRIPTION OF THE DRAWINGS

Further advantages, features and details emerge from the description below of an exemplary embodiment and with reference to the drawings. The features and combinations of features mentioned above in the description and the features and combinations of features which are mentioned below in the description of the figures and/or are solely shown in the figures are usable not only in the respectively stated combination, but also in other combinations or on their own without departing from the scope of the invention.

In the drawing.

DETAILED DESCRIPTION OF THE PREFERRED EMBODIMENT

Figure 1:
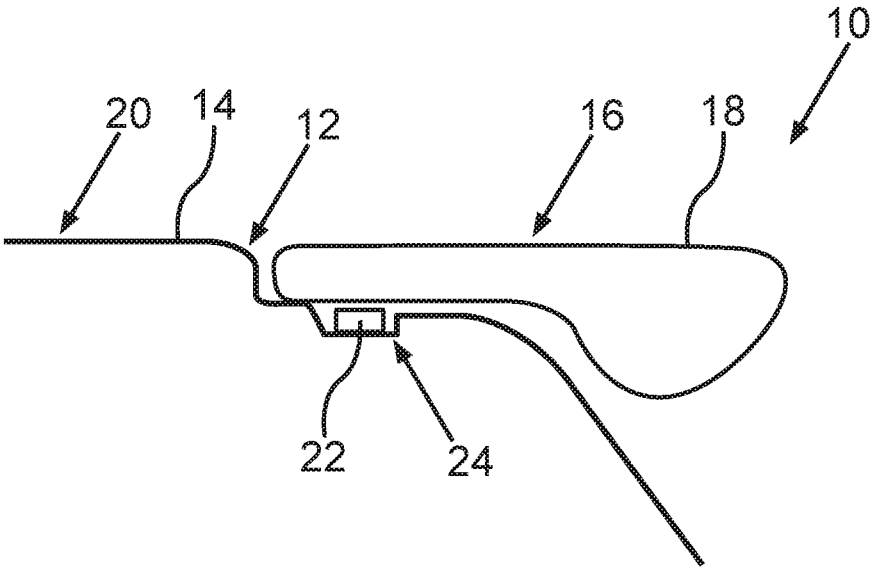
Fig.1 RELATED ART
FIG. 1 is a schematic sectional view of a motor vehicle with a rear spoiler and an antenna according to the related art.

Reference will now be made in detail to the preferred embodiments, examples of which are illustrated in the accompanying drawings, wherein like reference numerals refer to like elements throughout.

Figure 2:
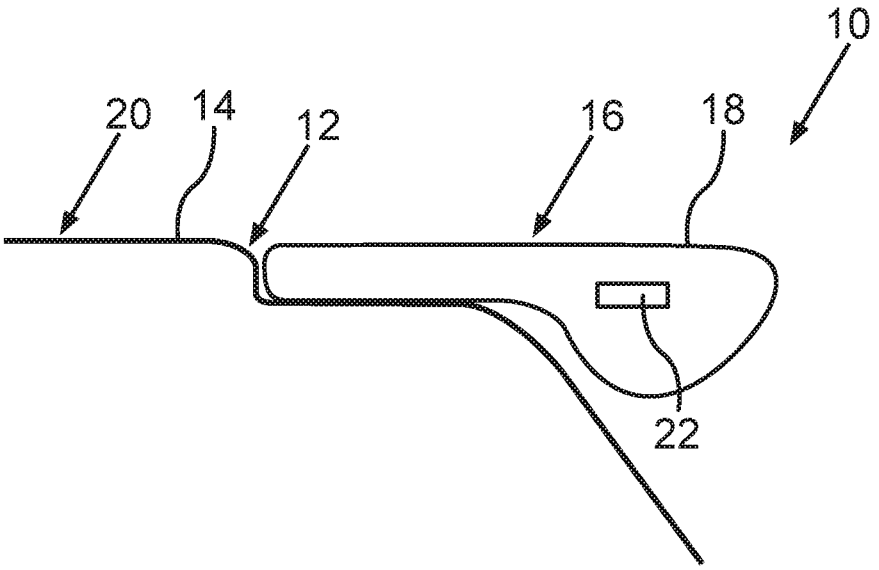
Fig.2 RELATED ART
FIG. 2 is a schematic sectional view of another embodiment of a motor vehicle with a rear spoiler and an antenna according to the related art.

FIGS. 1 and 2 each show a schematic sectional view of part of a rear of a motor vehicle 10 according to the related art. At a roof edge 12 which is at the top in the vertical direction of the vehicle and is at the rear in the longitudinal direction of the vehicle, a rear spoiler 16 according to the related art, which is substantially formed from a rear spoiler body 18, is in each case connected here to a vehicle body 14. The rear spoiler body 18 is, for example, a component which is made from plastic and is screwed to the vehicle body 14. The rear spoiler body 18 adjoins a roof 20 of the motor vehicle 10 in a substantially flush manner here. The rear spoiler body 18 is shaped in such a manner that, during forward travel of the motor vehicle 10, it influences the flow of air around the vehicle. As a result, in particular an aerodynamic improvement of the motor vehicle 10 is intended to be brought about, for example by downforce being increased. Alternatively, however, the rear spoiler body 18 can also serve primarily as a decorative part for achieving a certain visual appearance of the motor vehicle 10.

The number of antennas to be installed in motor vehicles is constantly increasing because of new services and increasing demands made on the quality and data rate of wireless services of a motor vehicle 10. This can lead, for example, to six to seven antennas being positioned in a manner spaced apart from one another on a motor vehicle. Typical positionings here are, for example, in respective bumpers and on the roof of the motor vehicle 10. The performance of an antenna is dependent, inter alia, on the package thereof on the motor vehicle 10. An antenna positioned in the interior typically has a poorer performance than an externally positioned antenna. Furthermore, better performance is typically obtained when antennas are positioned higher. For example, an antenna on a roof of the motor vehicle 10 has radiating characteristics that are less directional than in a bumper.

The two FIGS. 1 and 2, here show two variants of an antenna 22 on the motor vehicle 10. In the variant according to FIG. 1, the antenna 22 is arranged below the rear spoiler body 18 in a recess 24 of the vehicle body 14. As a result, however, construction space is taken up in an interior of the motor vehicle 10. In particular, a maximum head room in the interior of the motor vehicle 10 is thereby reduced by the inwardly projecting bulge of the vehicle body 14 because of the recess 24.

By contrast, in the variant according to FIG. 2, the antenna 22 is integrated in a cavity of the rear spoiler body 18. However, such an arrangement of the antenna 22 in the rear spoiler body 18 causes considerable additional costs and an increased outlay on logistics. In this case, the antenna 22 has to be produced together with the rear spoiler body 18. As a result, it is no longer possible to install or not to install the antenna 22 depending on requirements. The decision as to whether the antenna 22 is to be installed can no longer be undertaken, for example, during the mounting of the rear spoiler body 18 on the vehicle body 14 on the assembly line, but rather already has to be undertaken during the assembly of the rear spoiler body 18 itself. Secondly, at least an at least partial removal of the rear spoiler body 18 for the fitting of the antenna 22 is necessary.

Figure 3:
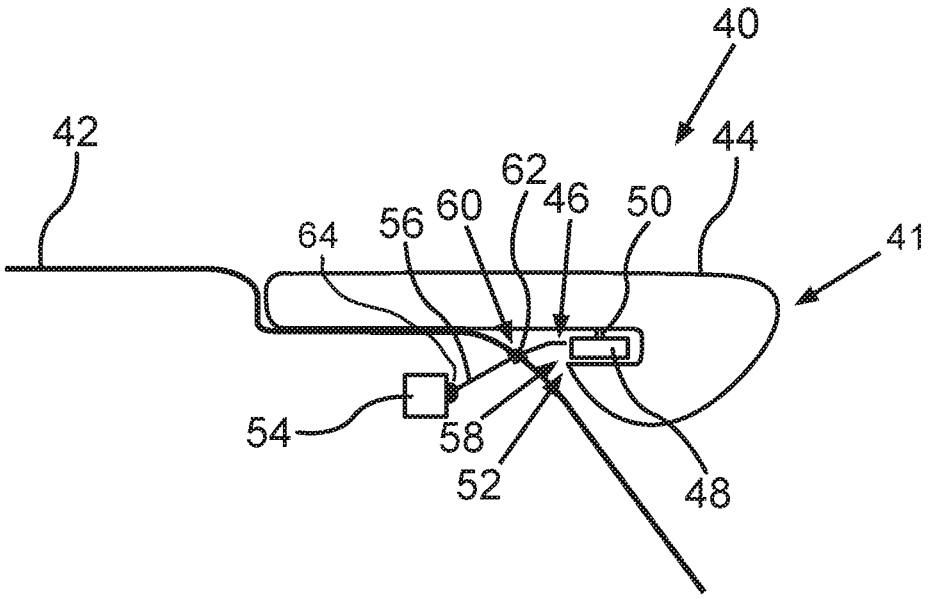
FIG. 3 is a schematic sectional view of a motor vehicle with a rear spoiler and an antenna.

These disadvantages do not occur in the motor vehicle 40 described herein with the rear spoiler 41, part of which is shown in the schematic sectional view in FIG. 3. The vehicle body 42 of the motor vehicle 40 does not have a recess for an antenna. As a result, the vehicle body 42 can be produced particularly cost-effectively and head room in an interior of the motor vehicle 40 is not restricted. It is also unnecessary to already integrate an antenna previously in a rear spoiler body 44 of the rear spoiler 41.

Instead, the rear spoiler body 44 has a recess 46 for accommodating the antenna 48. As a result, an antenna 48 can be integrated from the outside in the rear spoiler 41, which is substantially formed by the rear spoiler body 44. In addition, the rear spoiler body 44 has a measure 50 for fastening the antenna 48, the measure being designed here, for example, as a fastening element, in particular part of a clip connection for fastening the antenna 48 in the recess 46. The rear spoiler body 44 can therefore already be completely assembled as a supplier part and/or supplied painted for final assembly of the motor vehicle 40. A decision can then be taken just before the final mounting of the rear spoiler body 44 on the vehicle body 42 as to whether the antenna 48 is to be installed. As a result, corresponding logistics are particularly simple and flexible, and the motor vehicle 40 can be produced particularly cost-effectively.

Respective engagements and structural changes of the rear spoiler body 44 are arranged here in a region not visible to customers. For example, the recess 46 is arranged on a side 52 facing the vehicle body 42 in the installed position of the rear spoiler body 44. As a result, the antenna 48 is covered by the rear spoiler body 44 without further trim panels. In addition, the antenna 48 is thus at least partially protected by the rear spoiler body 44 against environmental influences.

Use can therefore be made of the good antenna position in the rear spoiler 41. It is not necessary for this purpose to already take into consideration during the production or during the assembly of the rear spoiler body 44 whether the antenna 48 is to be installed in the final motor vehicle 40.

By arranging the antenna 48 in the recess 46, the antenna is also at a particularly great distance from surrounding metal parts, which generally signifies a better antenna performance. Thus, a rear spoiler body 44 formed from a plastic is advantageous. A galvanic coupling between the antenna 48 and the rear spoiler body 44 can thereby also be avoided.

By use of a clip connection as the measure 50 for fastening the antenna 48, short manufacturing times during the assembly of the antenna 48 on the assembly line can be achieved. In particular, a tool does not have to be used for fastening the antenna 48 to the rear spoiler body 44.

The antenna 48 is connected to a transceiver unit 54 of the motor vehicle 40 by an electric connecting line 56. The connecting line 56 is soldered, for example, to the antenna 48. A connecting point between the connecting line 56 and the transceiver unit is cast in a plastic. The connection of the connecting line 56 to the antenna 48 is thereby protected from moisture. It is therefore not necessary to seal the space 58, which is formed by the vehicle body 42 and the rear spoiler body 44, against penetrating water. The connecting line 56 is guided through the vehicle body 42 through a through opening 60 into an interior of the vehicle body 42. The through opening 60 is sealed with a grommet 62 through which the connecting line 56 is likewise guided. As a result, the vehicle body 42 is sealed upon passage of the connecting line 56, and therefore protection of the connection of the transceiver device 54 to the connecting line 56 from penetrating water can be dispensed with.

Alternatively or additionally, the connecting line 56 can also be guided together with other lines from the outside inward through the vehicle body 42 through a common through opening 60. A seal, in particular the grommet 62, can optionally be dispensed with here. In this case, the connection between the transceiver device 54 and the connecting line 56 may be designed so as to be protected against penetrating water. For example, the connecting line 56 can be connected to the transceiver device 54 with a waterproof plug 64. The transceiver device 54 can then also be arranged in what is referred to as a moist space of the motor vehicle 40.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

The invention claimed is:

1. A rear spoiler for a motor vehicle having a vehicle body and at least one antenna, comprising:

a rear spoiler body influencing a flow around the motor vehicle when installed, the rear spoiler body having, on a surface, a recess and a measure for fastening the at least one antenna of the motor vehicle, the recess provided on a side of the rear spoiler body facing the vehicle body and, with the rear spoiler body in an installed position, the vehicle body and the rear spoiler body together forming a cavity in which the antenna is accommodated.

2. The rear spoiler as claimed in claim 1, wherein the measure for fastening the antenna is a fastening element configured as part of a clip connection.

3. The rear spoiler as claimed in claim 2, wherein, in the installed position of the rear spoiler body on the motor vehicle, the recess is accessible to mount the antenna in the recess.

4. The rear spoiler as claimed in claim 1, wherein the measure for fastening the antenna is configured, in preparation to adhesively bond the antenna to the rear spoiler body in the recess, as at least one of a protective film, an unpainted partial region of the surface of the rear spoiler body and a grease-free partial region of the surface of the rear spoiler body.

5. The rear spoiler as claimed in claim 4, wherein, in the installed position of the rear spoiler body on the motor vehicle, the recess is accessible to mount the antenna in the recess.

6. The rear spoiler as claimed in claim 1, wherein, in the installed position of the rear spoiler body on the motor vehicle, the recess is accessible to mount the antenna in the recess.

7. A rear spoiler system for a motor vehicle having a vehicle body, comprising:

a rear spoiler having a rear spoiler body influencing a flow around the motor vehicle when installed, the rear spoiler body having a recess on a surface facing the vehicle body; and an antenna fastened to the rear spoiler body and accommodated in a cavity formed by the vehicle body and the recess in the rear spoiler body with the rear spoiler body in an installed position.

8. The rear spoiler system as claimed in claim 7, wherein the measure for fastening the antenna is a fastening element configured as part of a clip connection.

9. The rear spoiler system as claimed in claim 8, wherein, in the installed position of the rear spoiler body on the motor vehicle, the recess is accessible to mount the antenna in the recess.

10. The rear spoiler system as claimed in claim 7, wherein the measure for fastening the antenna is configured, in preparation to adhesively bond the antenna to the rear spoiler body in the recess, as at least one of a protective film, an unpainted partial region of the surface of the rear spoiler body and a grease-free partial region of the surface of the rear spoiler body.

11. The rear spoiler system as claimed in claim 10, wherein, in the installed position of the rear spoiler body on the motor vehicle, the recess is accessible to mount the antenna in the recess.

12. The rear spoiler system as claimed in claim 7, wherein, in the installed position of the rear spoiler body on the motor vehicle, the recess is accessible to mount the antenna in the recess.

13. A motor vehicle, comprising:

a vehicle body;

a rear spoiler system including a rear spoiler with a rear spoiler body influencing a flow around the motor vehicle, the rear spoiler body having a recess on a surface facing the vehicle body; and an antenna fastened to the rear spoiler body and accommodated in a cavity formed by the vehicle body and the recess in the rear spoiler body.

14. The motor vehicle as claimed in claim 13, further comprising:

an interior;

a grommet sealing the vehicle body;

a transceiver device in the interior of the motor vehicle; and a connecting line connecting the transceiver device and the antenna and passing through the vehicle body via the grommet sealing the vehicle body.

15. The motor vehicle as claimed in claim 14, wherein the connecting line is connected to the transceiver device by a waterproof plug.

16. The motor vehicle as claimed in claim 13, wherein the measure for fastening the antenna is a fastening element configured as part of a clip connection.

17. The motor vehicle as claimed in claim 16, wherein, in the installed position of the rear spoiler body on the motor vehicle, the recess is accessible to mount the antenna in the recess.

18. The motor vehicle as claimed in claim 13, wherein the recess is accessible to mount the antenna in the recess.

* * * * *